US007245260B2

(12) United States Patent
Chang

(10) Patent No.: US 7,245,260 B2
(45) Date of Patent: Jul. 17, 2007

(54) DUAL BAND ANTENNA

(75) Inventor: Chun Yi Chang, Yi Lan Hsien (TW)

(73) Assignee: Benq Corporation, Taoyuan, Taiwan (CN)

( * ) Notice: Subject to any disclaimer, the term of this patent is extended or adjusted under 35 U.S.C. 154(b) by 0 days.

(21) Appl. No.: 10/862,864

(22) Filed: Jun. 7, 2004

(65) Prior Publication Data

US 2005/0007279 A1 Jan. 13, 2005

(30) Foreign Application Priority Data

Jun. 24, 2003 (TW) ..... 92117137 A

(51) Int. Cl.
*H01Q 1/38* (2006.01)

(52) U.S. Cl. ..... 343/700 MS; 343/702; 343/895

(58) Field of Classification Search ..... 343/700 MS, 343/702, 895, 718, 725, 843
See application file for complete search history.

(56) References Cited

U.S. PATENT DOCUMENTS

| | | | | |
|---|---|---|---|---|
| 6,204,826 | B1 * | 3/2001 | Rutkowski et al. | 343/895 |
| 6,795,026 | B2 * | 9/2004 | Chiu et al. | 343/702 |
| 6,987,483 | B2 * | 1/2006 | Tran | 343/700 MS |
| 2003/0122722 | A1 * | 7/2003 | Sugiyama et al. | 343/700 MS |
| 2004/0095281 | A1 * | 5/2004 | Poilasne et al. | 343/702 |

* cited by examiner

*Primary Examiner*—Hoang Nguyen
*Assistant Examiner*—Ephrem Alemu
(74) *Attorney, Agent, or Firm*—Ladas and Parry LLP

(57) ABSTRACT

A dual band antenna includes a metal strip and a feeding leg. The metal strip formed on a substrate further comprises a first band portion and a second band portion, in which a tail of the first band portion is connected to the second band portion. The feeding leg extended from a head of the first band portion is led to connect with a signal processing circuit. The metal strip can be tuned to second frequency band signals, in which the first band portion is purposely tuned to first frequency band signals. Also, the second band portion has a function of adjusting frequencies of the second frequency band.

13 Claims, 3 Drawing Sheets

DUAL BAND ANTENNA

CROSS RELATED APPLICATION

This Application claims the priority of Taiwanese Application No. 092117137 filed Jun. 24, 2003.

BACKGROUND OF THE INVENTION (1) Field of the Invention

The invention relates to antennas, and more particularly to multi-band antennas formed on printed circuit boards.

(2) Description of the Prior Art

With current developments in communication technology, many electronic devices need antennas which can receive and transmit signals in two frequency ranges, three frequency ranges, or more. Commercially, one of major concerns upon those multi-band products is their efficiency, appearance, size, etc. Actually in most communication devices, the efficiency of signal transmission is the most important of all. In particular, the performance of the antenna in the communication device takes a major share to the efficiency of signal transmission. Generally, to achieve a modern appearance design of the communication device without sacrificing the efficiency of antenna has become the major goal to most designers in this industry.

For example, U.S. Pat. No. 6,166,694 to Zhinong Ying, Lund describes a multi-band antenna titled as "Printed Twin Spiral Dual Band Antenna". As shown in FIG. 1 thereof, the dual band antenna is attached over the printed circuit board (PCB) 1 via a dielectric substrate 2 and is also connected with the PCB 1 through a feeding pin 6 and a grounded post 7. A matching bridge 5 is introduced to connect the feeding pin 6 and the grounded post 7. As shown, the dual band antenna assembly comprises two conductor arms, each of which, a first spiral arm 3 and a second spiral arm 4, is configured in an inner spiral shape. The first spiral arm 3 is tuned to receive lower frequency band signals, while the second spiral arm 4 is tuned to receive higher frequency band signals. Under such an arrangement, the antenna assembly is allowed to operate in multiple frequency bands.

As shown in FIG. 1, a dielectric substrate 2 is positioned between the antenna assembly and the printed circuit board 1. In manufacturing process, an extra process should be increased in order to form the dielectric substrate 2 on the PCB 1. Moreover, the antenna assembly and the main circuit wires of the communication device are manufactured in different processes. If simplifying the manufacturing process is possible, the manufacturing time can be definitely saved. Additionally, an additional space on the PCB 1 is needed for constructing the antenna assembly, and as a consequence layout complexity of the main circuit wires has been increased. Therefore, an easy solution for constructing a multi-band transmission device with a PCB having a built-in planer antenna is surely welcome to the skilled person in the art.

SUMMARY OF THE INVENTION

Accordingly, it is one object of the present invention to provide a design of dual band antenna.

It is another object of the present invention to provide a multi-band antenna which can be manufactured with the main circuit wires of the communication device simultaneously.

In one aspect of the present invention, the dual band antenna comprises a metal strip and a feeding leg. The metal strip attached on a substrate includes two-band portion, a first band portion and a second band portion. Both the first and the second band portions are formed respectively as L-like metal strips. Furthermore, a tail of the first band portion (also known as a short part of the first L shape) is connected to a head of the second band portion (also known as a long part of the second L shape). Moreover, the feeding leg is extended from a head of the first band portion so as to connect a signal processing circuit. The signal processing circuit can receive either signals within the first band or signal within the second band. The first band portion of the metal strip for the dual band antenna has a predetermined length, generally a quarter wavelength of the operating frequency of the first band portion so as to resonate at frequencies in a lower first frequency band. Equally, by adjusting the length of the second band portion of the metal strip, the dual band antenna is capable of being tuned at frequencies in a higher second frequency band. By means of the signal processing circuit, the dual band antenna can then process the first frequency band signals and the second frequency band signals. It is well known that the lower frequency band signals and the higher frequency band signals can be resonant at the first band portion of the metal strip, in which the higher frequency band is usually over 2.2 GHz (or higher) and is higher than conventional 1.7 GHz. Therefore, the purpose of increasing the second band portion is to lower the resonant frequency of the higher second frequency band such that the two frequency bands can be currently used.

In another aspect of the present invention, the dual band antenna is formed on different side of the substrate, and a conductive aperture of the substrate is utilized to connect the first band portion and the second band portion of the metal strip. Same as the former aspect of the present invention: the first band portion and the second band portion are formed as the metal strip, each of which is shaped in L-like. Furthermore, the tail of the first band portion (also known as the short part of the first L shape) is connected to the head of the second band portion (also known as the long part of the second L shape). Moreover, the feeding leg is also extended from the head of the first band portion so as to connect a signal processing circuit. Both the current and the previous aspects of the invention hold similar operating frequencies such that communication devices with the antenna of the present invention can deal with dual band signal transmission.

The foregoing, as well as additional objects, features and advantages of the invention will be more readily apparent from the following detailed description which proceeds with reference to the accompanying drawings.

BRIEF DESCRIPTION OF THE DRAWINGS

The present invention will now be specified with reference to its preferred embodiment illustrated in the drawings, in which.

DESCRIPTION OF THE PREFERRED EMBODIMENT

Figure 1:
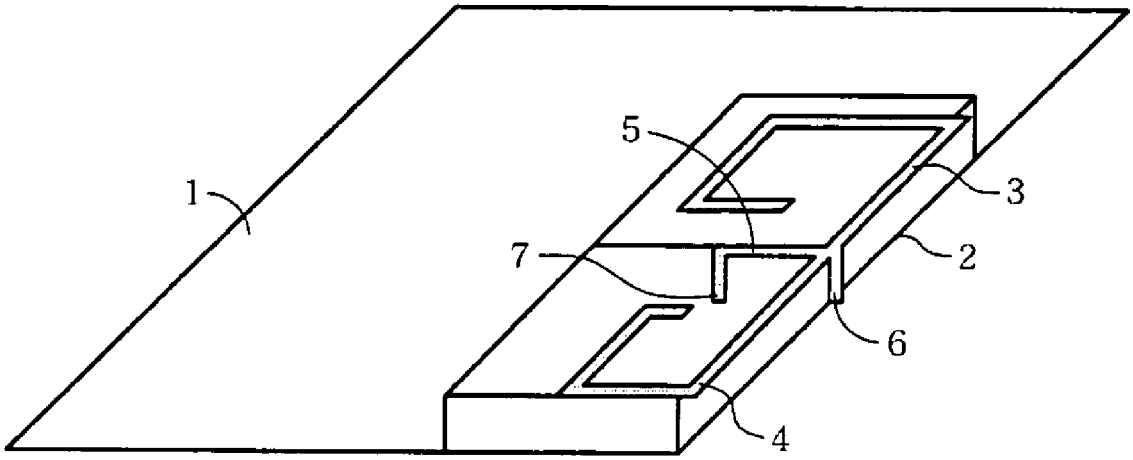
Fig. 1 (Prior Art)
FIG. 1 illustrates a built-in multiple band spiral antenna according to the prior art.
Figure 2:
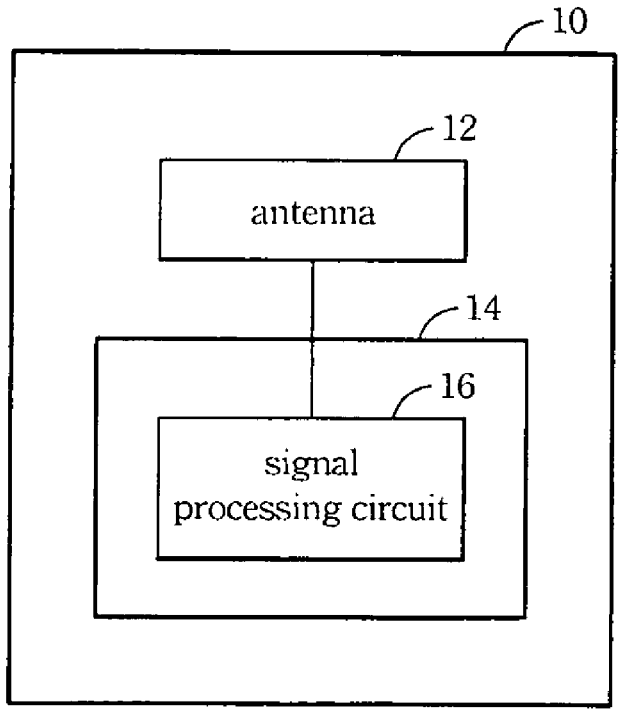
FIG. 2 illustrates a circuit block diagram according to a communication device of the present invention.

The invention disclosed herein is a design of multi-band antenna, and more particularly to a multi-band antenna formed on a printed circuit board and manufactured simultaneously with other circuitry. In the present invention, two band portions of the antenna assembly can be tuned to resonate at frequencies in two frequency bands and thus helped the communication devices with the antenna system achieve the dual band signal transmission. In FIG. 2, a circuit block diagram according to a preferred communication device of the present invention is shown. The attached assembly mounted on the printed circuit board 10 of the communication device includes an antenna assembly 12 and a main circuit 14. By means of the antenna assembly 12 and a signal processing circuit 16 which is a part of the main circuit 14, signal communication at frequencies in either the first frequency band or the second frequency band can thus be achieved. For example, the foregoing communication devices can be any mobile communication unit such as a cellular phone, a smart phone, a WLAN card, etc. In the following description, numerous details are set forth in order to provide a thorough understanding of the present invention. It will be appreciated by one skilled in the art that variations of these specific details are possible while still achieving the results of the present invention. In other instance, well-known components are not described in detail in order not to unnecessarily obscure the present invention.

Figure 3:
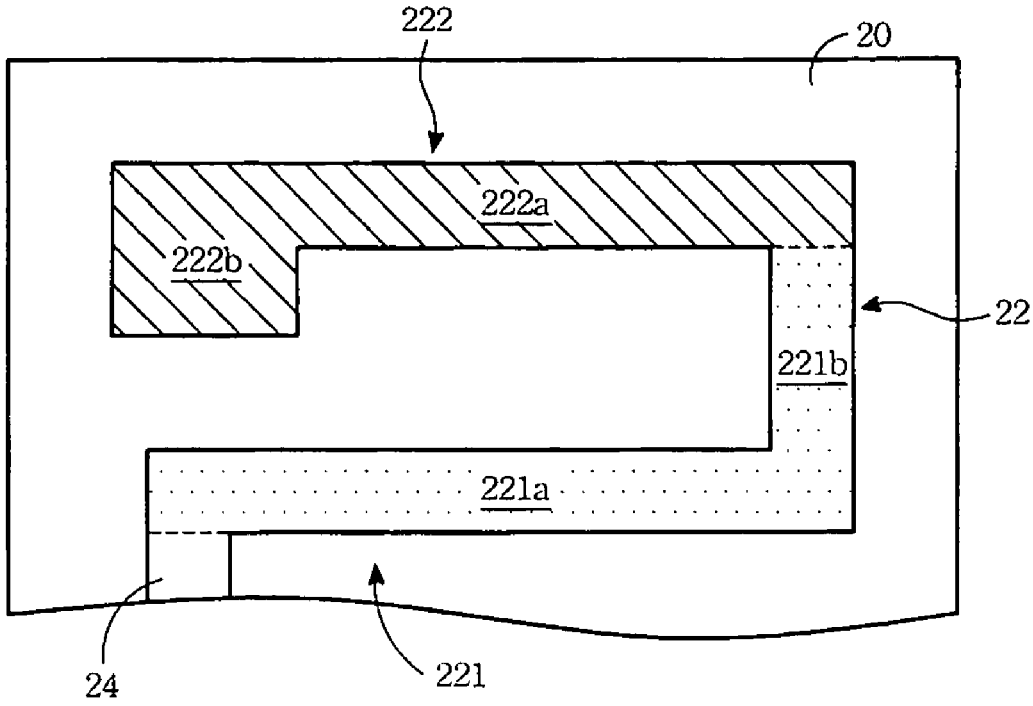
FIG. 3 illustrates a dual band antenna according to a first embodiment of the present invention.

As shown in FIG. 3, a dual band antenna according to the first embodiment of the invention is illustrated, in which the dual band antenna comprises a metal strip 22 and a feeding leg 24. The metal strip 22 attached on a substrate 20 includes two band portions, a first band portion 221 and a second band portion 222, each of which is shaped in L-like and mounted on the same surface of the substrate 20. Furthermore, a tail of the first band portion 221 (also known as the front end of the short part 221*b* of the first L shape) is connected to a head of the second band portion 222 (also known as the front end of the long part 222*a* of the second L shape). It should be noted that the long part 221*a* of the first band portion 221 parallels the long part 222*a* of the second band portion 222. Moreover, the feeding leg 24 is extended from another head of the first band portion 221 (also known as the front end of the long part 221*a* of the first band portion 221) so as to connect a signal processing circuit (not shown in the drawing). In the preferred embodiment, the substrate 20 can be chosen from a group of dielectric materials such as FR4, FR5, or PTFE, etc. Additionally, the metal strip 22 and the main circuit wires of the communication device can be made by performing a screen printing procedure to mount conducting metal (such as Cu, Ag, Au, or any alloy and combination thereof) on the substrate 20 where the first band portion 221 and the second band portion 222 are formed around edges of the substrate 20.

In the present embodiment, the first band portion 221 of the metal strip 22 of the dual band antenna has a length of, generally, a quarter wavelength of the first frequency band 221 so as to be resonant at frequencies in a lower first frequency band (the center frequency is about 900 MHz). By detail adjusting the length or width of the second band portion 222 of the metal strip 22, the dual band antenna is capable of being tuned at frequencies in a higher second frequency band (the frequency range is about 1.6 GHz~2.7 GHz). By means of the signal processing circuit (not shown in the drawing), the dual band antenna can then be able to process signals within a first frequency band or within a second frequency band.

Figure 4:
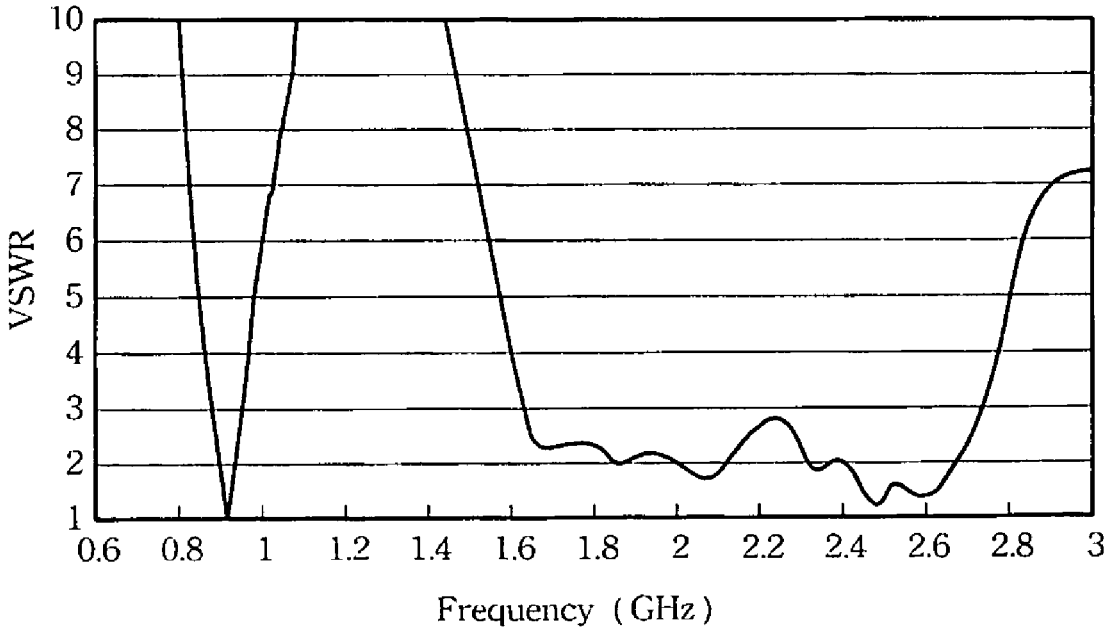
FIG. 4 illustrates a measurement result showing a typical return loss according to FIG. 3.

In FIG. 4, a measurement result of a typical return loss according to the first embodiment of the invention is shown. The return loss herein is expressed as a voltage standing wave ratio (VSWR) of the antenna drawn with respect to a linear frequency scale from 600 MHz to 3 GHz. In the drawing, as the VSWR=3, the lower operating frequency range (also known as the first frequency band of the present invention) is located at around 900 MHz corresponding to the frequency range of GSM and GPRS system. On the other hand, the higher operating frequency range (also known as the second frequency band of the present invention) approximately covers the frequency range of a DCS band, a PCS band or a wireless LAN protocols such as an IEEE 802.11b, or a 802.11g. Upon such an arrangement, the dual band antenna according to the present invention is then capable of multi-band signal transmission.

Figure 5:
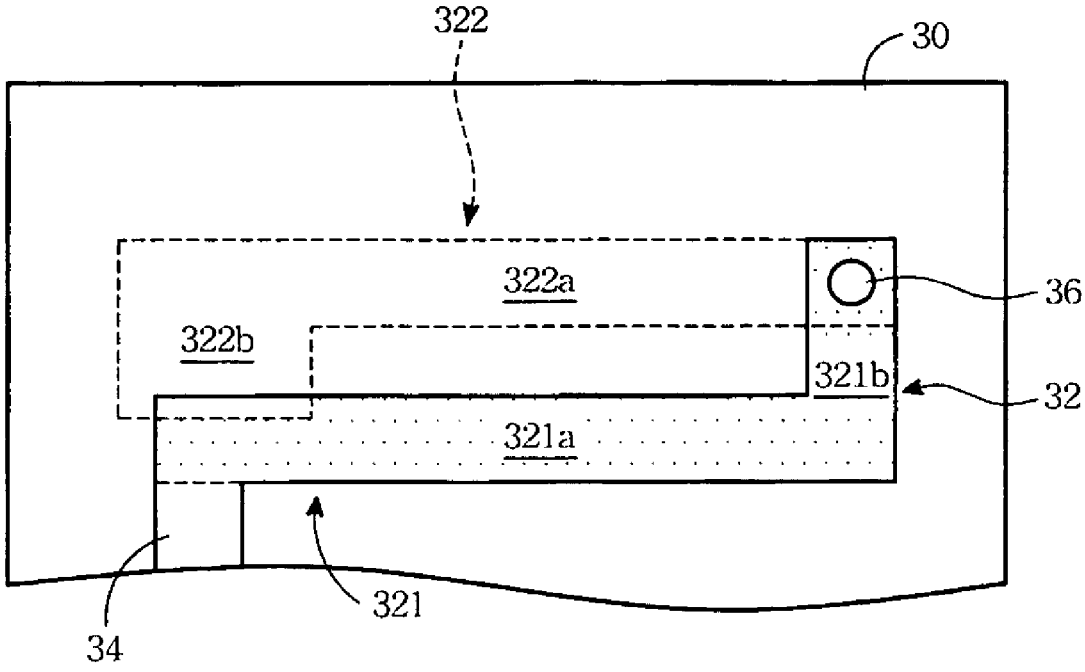
FIG. 5 illustrates a dual band antenna according to a second embodiment of the present invention.

FIG. 5 illustrates a dual band antenna according to the second embodiment of the present invention. The dual band antenna which is different from described above is formed on both sides (a first surface and an opposing second surface) of a substrate 30. A conductive aperture 36 of the metal strip 32 as shown is used to connect the first band portion 321 (mounted on the first surface) and the second band portion 322 (shown in dotted lines and mounted on the second surface). Nevertheless, similarly to the former embodiment of the present invention, the first band portion 321 and the second band portion 322 in this embodiment are also formed as the metal strip 32, each of which can be shaped in L-like. Furthermore, a tail of the first band portion 321 (also known as a front end of the short part 321*b* of the first L shape) is connected to a head of the second band portion 322 (also known as a front end the long part 322*a* of the second L shape). Besides, the long part 321*a* of the first band portion 321 parallels the long part 322*a* of the second band portion 322. Moreover, the feeding leg 34 is also extended from a head of the first band portion 321 (also known as a front end of the long part 321*a* of the first L shape) so as to connect a signal processing circuit (not shown in the drawing).

Figure 6:
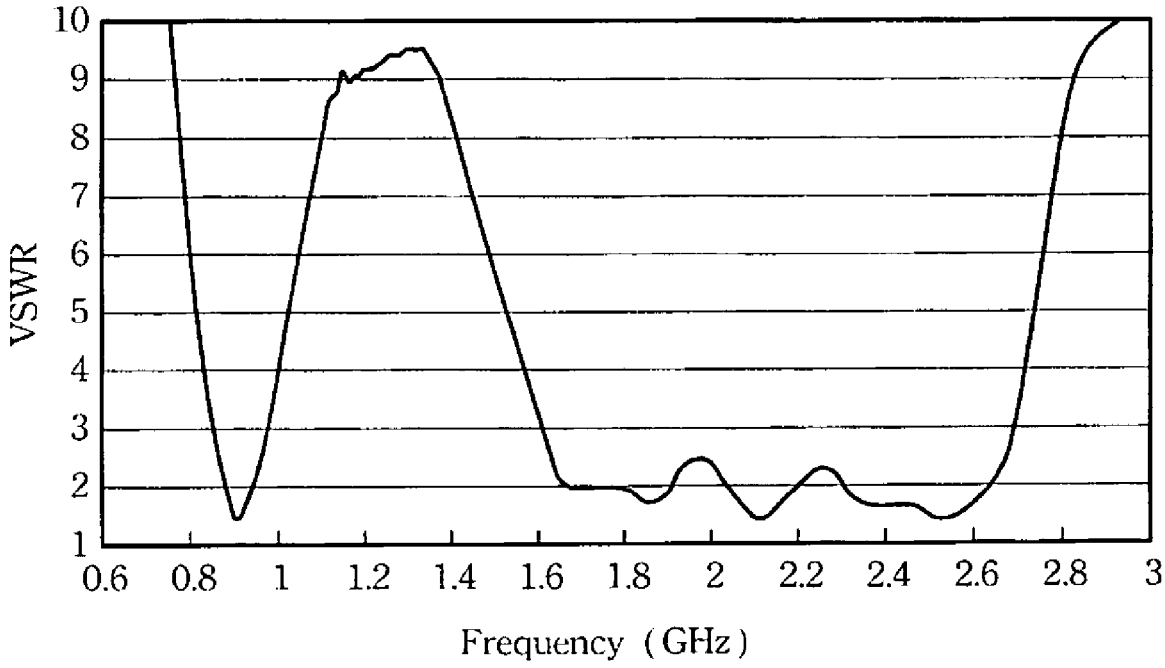
FIG. 6 illustrates a measurement result showing a typical return loss according to FIG. 5.

FIG. 6 shows a measurement result showing a typical return loss according to the second embodiment of the invention. Compared to FIG. 4, it is found that the VSWR response shown in FIG. 6 is identical in pattern with that shown in FIG. 4.

In summary, the dual band antenna of the invention provides at least following advantages over the conventional techniques.

1. The dual band antenna of the invention can provide an multi-band signal transmission, not an single-band signal transmission, so that the capability of the communication device can be upgraded.

2. The dual band antenna of the invention can use just a single current loop to obtain two resonance frequency bands.

3. The dual band antenna of the invention can be arranged around the edge of PCB so that the increasing upon the freedom of antenna assembly layout is possible and more free space for another uses such as holes for screw fastening can be gained.

4. The dual band antenna of the invention can be formed within the same manufacturing process of the main circuit wires for the communication devices so that the whole manufacturing time can be reduced.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as will as other embodiments, are intended to be included within the scope of the appended claims. The invention is defined by the following claims, with equivalents of the claims to be included therein.

I claim:

1. A dual band antenna for a communication device to transmit/receive radio signals within a higher frequency band and a lower frequency band, comprising:

a metal strip, formed on a substrate that includes a first surface and a second surface, and further comprising a first band portion and a second band portion wherein a tail of said first band portion is connected to said second band portion, wherein said first band portion is formed on said first surface, said second band portion is formed on said second surface, and said first band portion is electrically connected to said second band portion through a conductive aperture of said substrate; and a feeding leg, extended from a head of said first band portion so as to connect with a signal processing circuit;

wherein said first band portion has a predetermined length equal to a quarter wavelength of an operating frequency band of the lower frequency band, a length and a width of the second band portion being selectively adjustable for tuning the higher frequency band.

2. The dual band antenna of claim 1, wherein said first band portion is of L-shape having a short part and a long part, the short part of said first band portion is connected to said second band portion.

3. The dual band antenna of claim 1, wherein said second band portion is shaped of L-shape having a short part and a long part, the long part of said second band portion is connected to said first band portion.

4. The dual band antenna of claim 1, wherein said first band portion is resonant at frequencies in said lower frequency band and in said higher frequency band, said lower frequency band is approximately 900 MHz and said higher frequency band is in the range of 1.6 GHz to 2.7 GHz.

5. The dual band antenna of claim 4, wherein the adjusting frequencies of said higher frequency band serve to lower the frequencies of said higher frequency band.

6. A communication device provided to transmit/receive dual band radio signals within a higher frequency band and a lower frequency band, comprising:

an antenna; and a signal processing circuit, provided for selectively processing the higher frequency band signals and the lower frequency band signals through said antenna;

wherein said antenna further comprises:

a metal strip, formed on a substrate that further includes a first surface and a second surface, and comprising a first band portion and a second band portion wherein a tail of said first band portion is connected to said second band portion, said first band portion is formed on said first surface, said second band portion is formed on said second surface, and said first band portion is electrically connected to said second band portion through a conductive aperture of said substrate; and a feeding leg, extended from a head of said first band portion so as to connect with said signal processing circuit;

wherein said first band portion has a predetermined length equal to a quarter wavelength of an operating frequency of the lower frequency band, a length and a width of the second band portion being selectively adjusted for tuning the higher frequency band.

7. The communication device according to claim 6, wherein said first band portion is of L-shape having a short part and a long part, the short part of said first band portion is connected to said second band portion.

8. The communication device according to claim 6, wherein said second band portion is of L-shape having a short part and a long part, the long part of said second band portion is connected to said first band portion.

9. The communication device according to claim 6, wherein said first band portion is resonant at frequencies in said lower frequency band and in said higher frequency band, said lower frequency band is approximately 900 MHz and said higher frequency band is in the range of 1.6 GHz to 2.7 GHz.

10. The communication device according to claim 9, wherein said adjusting frequencies of said higher frequency band serve to lower the frequencies of said higher frequency band.

11. A communication device provided to transmit/receive dual band radio signals within a higher frequency band and a lower frequency band, comprising:

an antenna; and a signal processing circuit for selectively processing signals of the higher frequency band and the lower frequency band through said antenna;

wherein said antenna further comprises:

a metal strip, formed on a substrate, further comprising a first band portion and a second band portion wherein a tail of said first band portion is connected to said second band portion; and a feeding leg, extended from a head of said first band portion so as to connect with the signal processing circuit;

wherein said first band portion has a predetermined length equal to a quarter wavelength of an operating frequency band of the lower frequency band, a length and a width of the second band portion is selectively adjustable for tuning the higher frequency band.

12. The communication device according to claim 11, wherein said first band portion is resonant at frequencies in said lower frequency band and in said higher frequency band.

13. The communication device according to claim 11, wherein said lower frequency band is approximately 900 MHz and said higher frequency band is in the range of 1.6 Ghz to 2.7 GHz.

* * * * *